US009987656B2

(12) United States Patent
Nelson et al.

(10) Patent No.: US 9,987,656 B2
(45) Date of Patent: Jun. 5, 2018

(54) SYSTEM AND METHOD FOR REDUCING AIR INGRESSION INTO SEALANT TUBES

(71) Applicant: Spirit AeroSystems, Inc., Wichita, KS (US)

(72) Inventors: W. Robert Nelson, Wichita, KS (US); Jennifer Lyn Wilson, Wichita, KS (US); Gus A. Hohlios, Wichita, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 1 day.

(21) Appl. No.: 15/292,329

(22) Filed: Oct. 13, 2016

(65) Prior Publication Data

US 2017/0157639 A1 Jun. 8, 2017

Related U.S. Application Data

(60) Provisional application No. 62/264,123, filed on Dec. 7, 2015.

(51) Int. Cl.
*B05C 17/015* (2006.01)
*B05C 17/005* (2006.01)
*B65D 83/00* (2006.01)

(52) U.S. Cl.
CPC ..... *B05C 17/015* (2013.01); *B05C 17/00513* (2013.01); *B65D 83/0022* (2013.01)

(58) Field of Classification Search
CPC ..... B05C 17/015; B05C 17/00513; B65D 83/0022
USPC ..... 222/399, 326, 389
See application file for complete search history.

(56) References Cited

U.S. PATENT DOCUMENTS 3,813,012 A * 5/1974 Laird ..... B05C 17/015 222/326
2004/0074927 A1* 4/2004 Lafond ..... B05C 17/00503 222/327
2006/0043120 A1* 3/2006 Campbell ..... B05C 17/0146 222/386.5
2012/0160936 A1* 6/2012 Brummitt ..... B05B 7/045 239/322
2017/0225192 A1* 8/2017 Compton ..... B05C 17/00583

OTHER PUBLICATIONS

Mini Dispensing Gun, Semco, Model 250-A-Gun "Poly Dispensing Systems", 6 pages. http://www.polydispensing.com/wp-content/uploads/2015/05/FT_MiniGunDispensing_Model250A_EN.pdf.

* cited by examiner

*Primary Examiner* — Donnell Long
(74) *Attorney, Agent, or Firm* — Hovey Williams LLP

(57) ABSTRACT

A sealant tube for use in a pneumatic sealant gun for reducing or eliminating air bubbles in the sealant being dispensed. The sealant tube may fit within a hollow sleeve of the pneumatic sealant gun and contains sealant and a slidable plunger. The tube body may include an inner surface, an outer surface opposite the inner surface, a first opening, a second opening opposite the first opening, and pressure release openings formed through the tube body, such that air from a pressurized air source flows into the tube body and between the tube body and the hollow sleeve during use of the pneumatic sealant gun, equalizing pressure on the inner surface and the outer surface of the tube body. A seal or gasket may also be located proximate the second opening of the tube body, for forming an airtight seal between the hollow sleeve and the tube body.

20 Claims, 4 Drawing Sheets

SYSTEM AND METHOD FOR REDUCING AIR INGRESSION INTO SEALANT TUBES

RELATED APPLICATIONS

The current non-provisional patent application claims priority benefit, with regard to all common subject matter, of U.S. Provisional Application No. 62/264,123, titled "System and Method for Reducing Air Ingression Into Sealant Tubes," filed Dec. 7, 2015, hereby incorporated by reference in its entirety into the current application.

BACKGROUND

Sealant is often used in the aircraft industry to seal gaps and fill holes in or between parts. Sealant is typically loaded into disposable, cylindrical, plastic tubes, each having an open end on which a nozzle may be placed. A moveable plunger at the opposite end of the tube causes sealant to extrude out of the nozzle when pressed against the sealant.

Several types of sealant dispensing mechanisms have been developed for actuating the plungers of sealant tubes. Manually-operated sealant guns include a manually operated trigger or other mechanism for pushing a plunger to urge sealant from a sealant tube. Such manually-operated sealant guns are slow to operate and require large amounts of manual force to be effectively used in large scale manufacturing operations such as aircraft manufacturing plants.

Electric-powered sealant guns use motors or pistons to dispense sealant more quickly and with less manual effort than manually-operated sealant guns, but they are relatively large, heavy, and cumbersome and are therefore not ideal for use in confined or hard-to-reach spaces.

Pneumatic sealant guns employ pressurized air to move the plungers in sealant tubes and are typically lighter, more compact, and therefore easier to operate than electric-powered sealant guns or electro-mechanical sealant guns. However, pneumatic sealant guns can introduce unwanted air into sealant, resulting in air bubbles and related deformities in the extruded sealant. Extruded sealant that contains air bubbles often must be removed and re-applied, especially when used on aircrafts and other high value items. Removing extruded sealant from an aircraft or other component is costly and time-consuming. To avoid this, many workers only use a portion of the sealant in a tube and then dispose of the rest, because air bubbles more commonly form in the last portion of the sealant dispensed from a tube. This is wasteful, costly, and only partially effective, because air bubbles can infiltrate further into a sealant tube.

SUMMARY

The present invention solves the above-described problems and provides a distinct advance in the art of sealant dispensing methods and mechanisms. Specifically, Applicant discovered that air bubbles in extruded sealant are caused by unintended inflation of sealant tubes during extrusion. In prior art pneumatic sealant guns, pressurized air from the sealant gun pressurizes a sealant tube in order to move a plunger therein, but also inadvertently causes the sealant tube to expand or bulge outward away from its plunger such that the plunger no longer forms an air-tight seal with an inner wall of the sealant tube. The sealant tube is disposed within a rigid sleeve of the sealant gun, but there is a small clearance gap between the sealant tube and the sleeve in which the sealant tube can expand. This allows pressurized air from the pneumatic sealant gun to seep between the plunger and an inner surface of the sealant tube, causing pockets of air to form in the sealant. As the plunger extrudes the sealant from the tube, these pockets of air are eventually pushed toward the dispensing opening of the tube and are extruded out of the tube. The air pockets cause air bubbles or other related deformities to form in the sealant extruded from the sealant gun.

To address this problem, the present invention provides an improved sealant tube for use in a dispensing gun, and a method of using the same, to pneumatically dispense sealant from the sealant tube without allowing unwanted air to infiltrate the sealant in the tube. The sealant tube is designed so as not to swell or inflate when subjected to pressurized air from a pneumatic gun. In one embodiment of the invention, this is achieved by equalizing the air pressure on both sides of the sealant tube to prevent such swelling.

One embodiment of the sealant tube includes a hollow tube body and a plunger that slides within the tube body. The tube body may fit within a hollow sleeve of a pneumatic sealant gun and may contain sealant therein. The tube body has an inner surface, an outer surface opposite the inner surface, a first opening, a second opening opposite the first opening, and one or more pressure release openings formed through the tube body. The plunger may be pressed toward the second opening of the tube body when compressed or pressurized air or gas is dispensed from the pneumatic sealant gun. The pressure release openings are located between the first opening of the tube body and the plunger, so that gas or air flowing through the first opening flows into the tube body and between the tube body and the hollow sleeve during use of the pneumatic sealant gun, thereby equalizing pressure on the inner surface and the outer surface of the tube body. The sealant tube may also include a seal or gasket forming an airtight seal between the hollow sleeve and the inner sealant tube proximate the second opening of the tube body.

Another embodiment of the invention is a pneumatic sealant gun including a sealant gun valve body, a hollow sleeve, and the sealant tube described above. The sealant gun valve body may fluidly couple with a source of compressed air or pressurized air and may include a valve-controlling mechanism for selectively blocking or allowing compressed air or pressurized air out of the sealant gun valve body. The hollow sleeve may have a first opening, through which the sealant tube may be received, and a second opening opposite the first opening. The hollow sleeve may be fluidly coupled with the sealant gun valve body via the first opening of the hollow sleeve.

Another embodiment of the invention is a method of using the pneumatic sealant gun described above. The method may include a step of loading the sealant tube into the hollow sleeve of the pneumatic sealant gun, and activating the pneumatic sealant gun to release compressed or pressurized air into the tube body, pressing the plunger toward the sealant, thereby pressing the sealant out of the second opening. The compressed or pressurized air flows into the tube body and through the pressure release openings then between the tube body and the hollow sleeve, thereby equalizing pressure on the inner surface and the outer surface of the tube body.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in more detail below with reference to the attached drawing figures, wherein.

Figure 1:
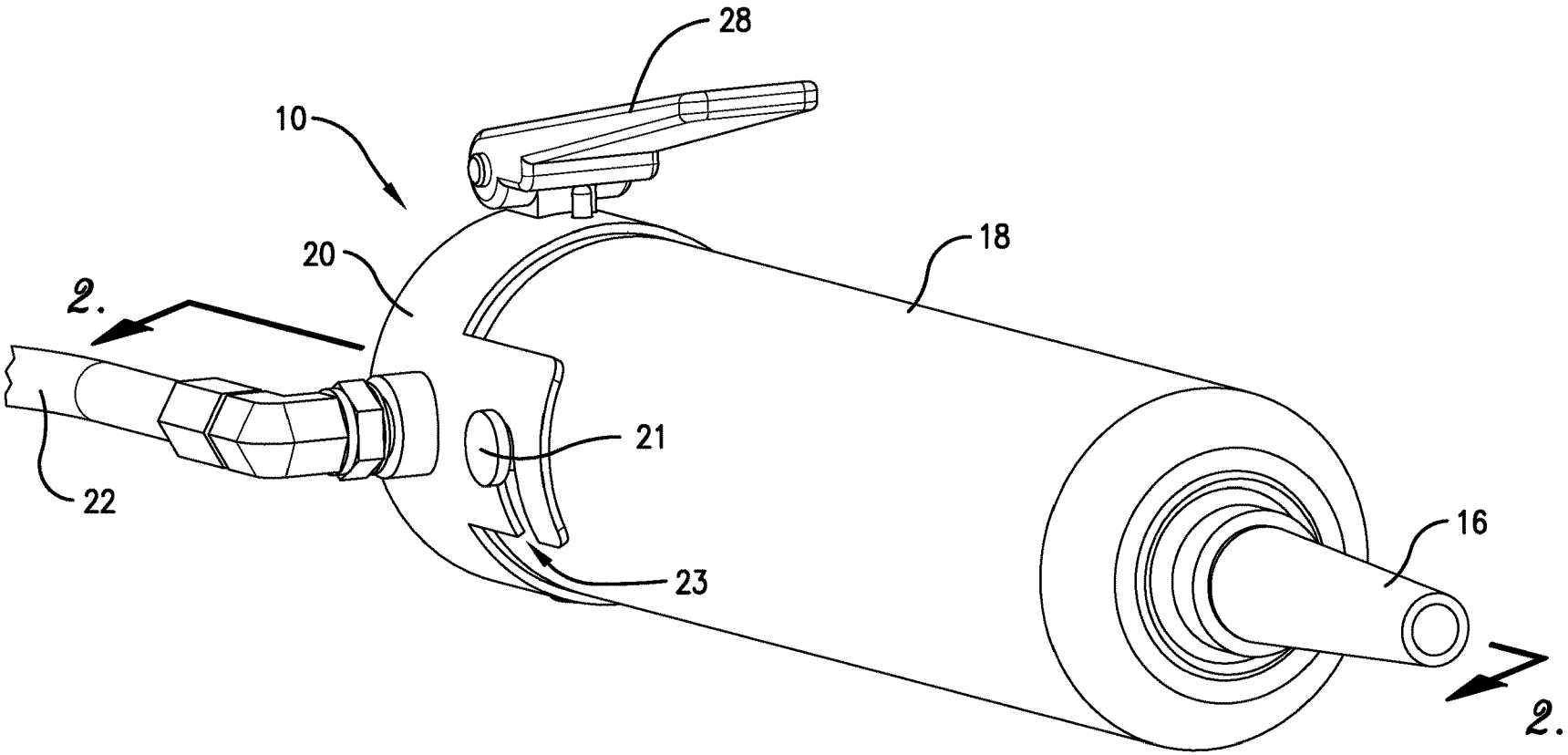
FIG. 1 is a perspective view of a pneumatic sealant gun constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, a sealant gun 10 and a sealant tube 12 constructed in accordance with embodiments of the invention are illustrated. As discussed in more detail below, the sealant gun 10 pnuematically dispenses sealant 14 from the sealant tube 12 via a dispensing nozzle 16, while resisting ingression of unwanted air into the sealant 14. This is achieved by equalizing the air pressure on both sides of the sealant tube 12 so that the tube 12 does not swell or inflate when subjected to pressurized air provided to the sealant gun 10. The sealant 14 may be any at least partially flowable adhesive, gel, or caulking used to block the passage of fluids through a surface or joints of various structures. Any sealant that is capable of being pressed through the dispensing nozzle 16 may be used without departing from the scope of the invention.

Figure 2:
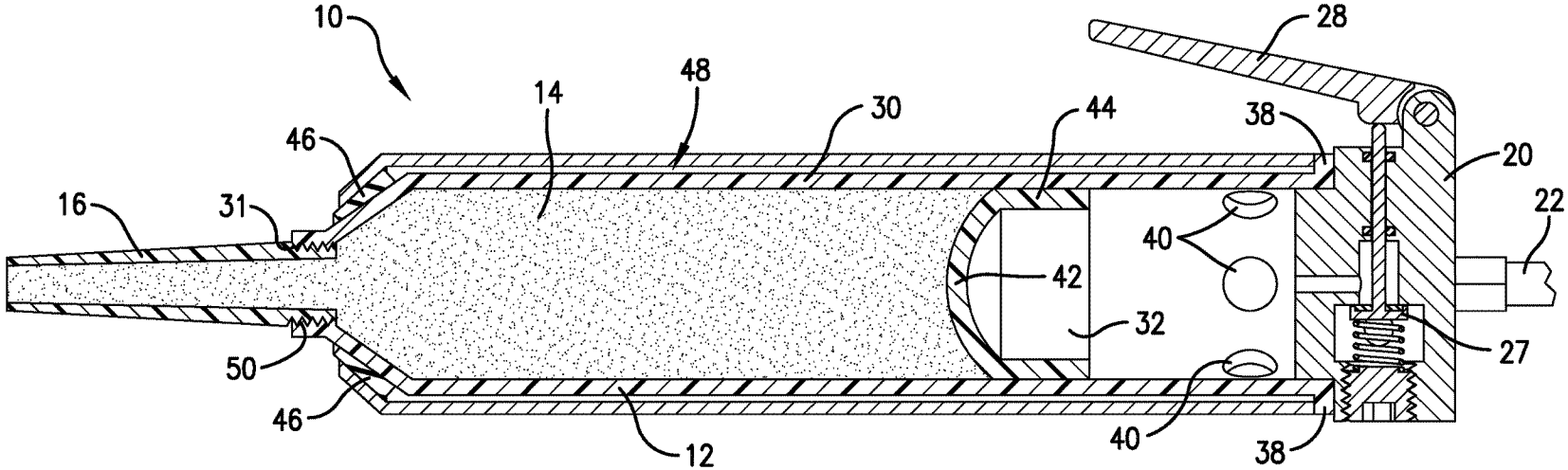
FIG. 2 is a vertical cross-sectional view taken along line 2-2 of FIG. 1 of the pneumatic sealant gun and a sealant tube constructed in accordance with embodiments of the present invention, with a plunger of the sealant tube in a first maximum fill position.
Figure 3:
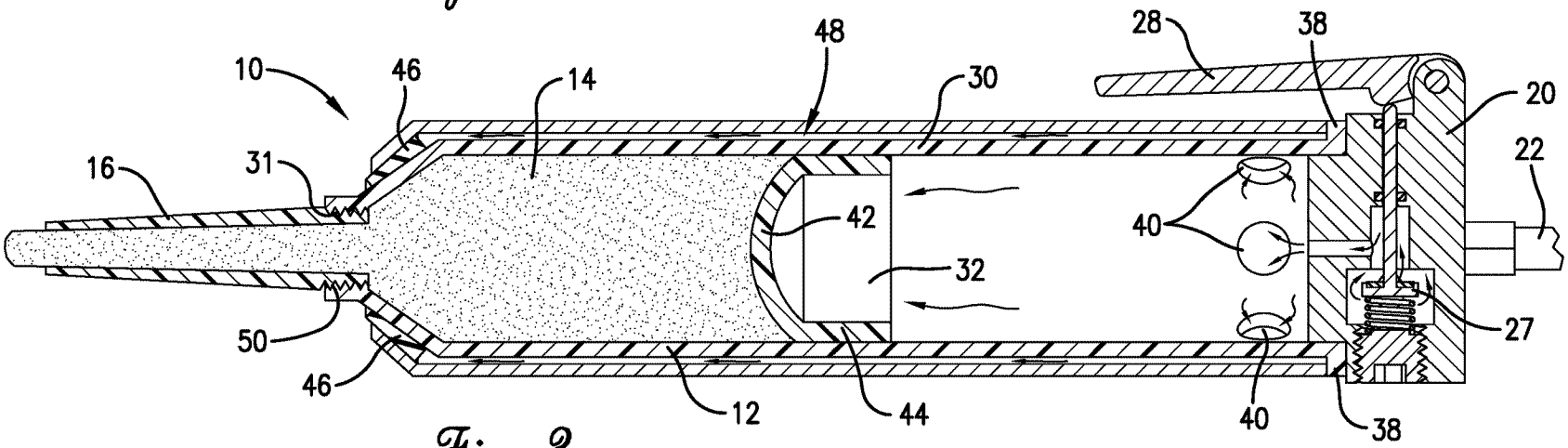
FIG. 3 is the vertical cross-sectional view of FIG. 2, but with the plunger of the sealant tube in a second position moved within the sealant tube body by compressed air via the pneumatic sealant gun.
Figure 4:
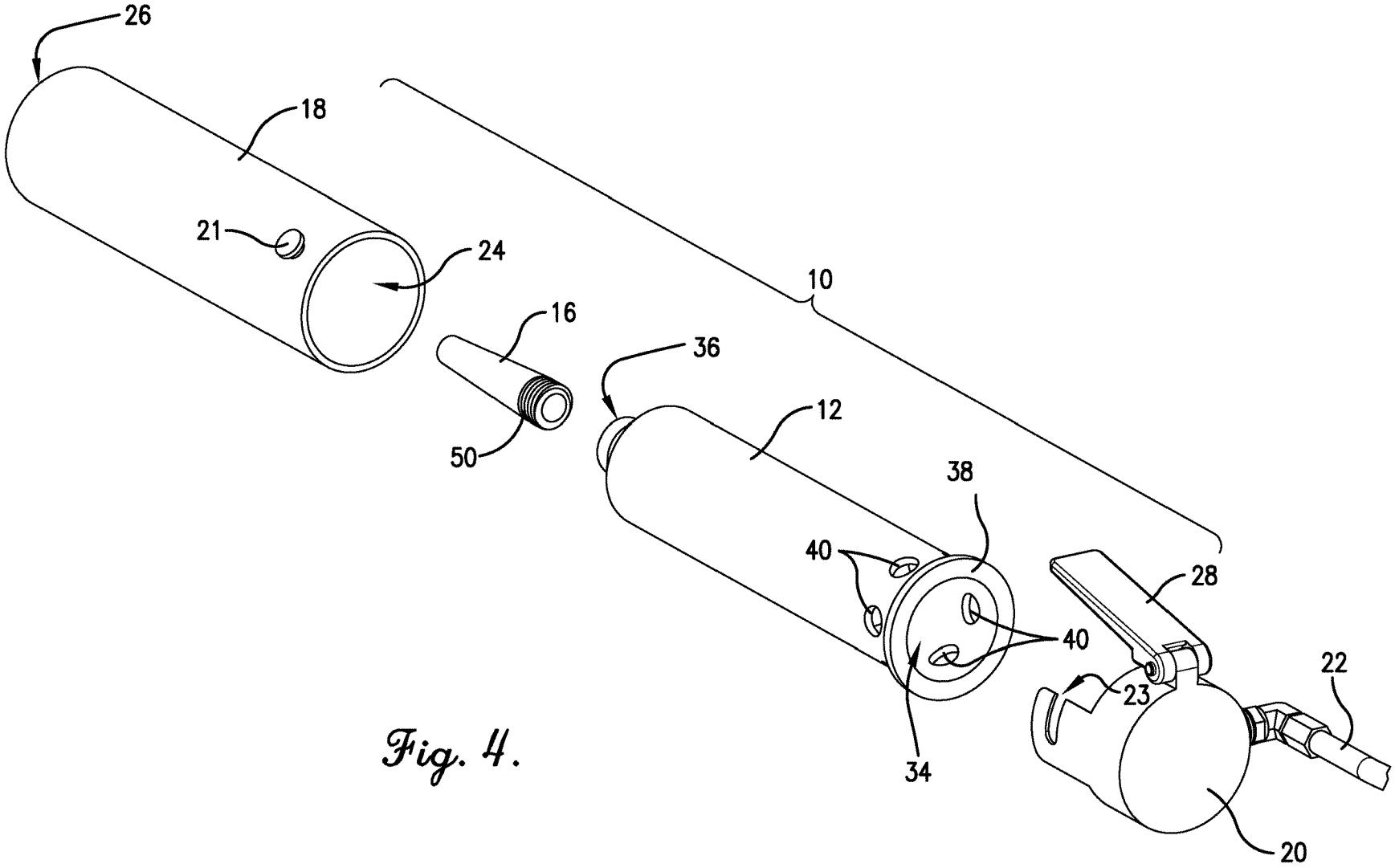
FIG. 4 is an exploded perspective view of the pneumatic sealant gun and the sealant tube, illustrating a plurality of pressure release openings formed through the sealant tube.

The sealant gun 10 may include a rigid hollow sleeve 18 and a sealant gun valve body 20 attachable to a forced air source 22, such as an air compressor or the like. For example, an air pressure in a range of 80 PSI to 130 PSI, such as 115 PSI may be provided to press sealant 14 from the sealant tube 12, as later described herein. The hollow sleeve 18 may have a first opening 24 and a second opening 26 opposite the first opening, as illustrated in FIG. 4. The hollow sleeve 18 may be fluidly coupled with the sealant gun valve body 20 via the first opening 24. In some embodiments of the invention, the hollow sleeve 18 may also be tapered at the second opening 26. The hollow sleeve 18 may include a mechanical attachment device 21, such as a protruding pin as illustrated in FIGS. 1 and 4, and the sealant valve body 20 may include an attachment slot 23 formed therein and configured to mate with the mechanical attachment device 21. As illustrated in FIGS. 2-3, the sealant gun 10 may further include a valve 27 and a lever 28 or some other valve-controlling mechanism associated with the sealant gun valve body 20 for selectively blocking or allowing air from the source of forced air 22 to flow into the hollow sleeve 18 via the valve 27.

As illustrated in FIGS. 2-3, the sealant tube 12 may include a tube body 30 for holding sealant therein and a plunger 32 configured to slidably move through the tube body 30 and press the sealant 14 out of the tube body 30 when forced air is applied thereto. The tube body 30 may be made of polyethylene or some other plastic or semi-flexible material and may have a first opening 34 and a second opening 36 opposite the first opening 34, as illustrated in FIG. 4. The tube body 30 may be configured to fit within the hollow sleeve 18 when slid through the first opening 24 of the hollow sleeve 18. The tube body 30 may taper proximate to the second opening 36 where the sealant 14 is dispensed therefrom. In some embodiments of the invention, a portion of the tube body 30 may extend outward from the hollow sleeve's second opening 26 and screw threads 31 or other attachment features may be molded into or otherwise included on an outer surface of the tube body 30 proximate to the second opening 36 thereof, such that the dispensing nozzle 16 may screw onto or otherwise attach to the tube body 30, as later described herein.

The tube body 30 may also include an engagement surface 38 proximate the first opening 34, configured to be sandwiched between the sealant gun valve body 20 and the hollow sleeve 18, creating an air-tight seal therewith. The engagement surface 38 may be, for example, a ring or flange extending radially outward from the tube body 30 relative to a center axis of the tube body 30. However, the engagement surface 38 may have other shapes or configurations without departing from the scope of the invention.

The tube body 30 may further have one or more pressure release openings 40 formed therethrough, such that air from the forced air source 22 can flow between the tube body 30 and a space (e.g., clearance gap) between the tube body 30 and the hollow sleeve 18, thereby equalizing pressure on an inner surface and an outer surface of the tube body 30. The pressure release openings 40 may comprise one or more holes, circular openings, rectangular openings, square openings, or any shape, quantity, and configuration of openings. In some embodiments of the invention, the pressure release openings 40 may comprise 9 holes and/or the holes may have diameters of 3/16 inch or 5/16 inch. However, the holes or pressure release openings 40 can be of any size and shape without departing from the scope of the invention. In some embodiments of the invention, the pressure release openings 40 may include a plurality of holes or slots having a staggered configuration.

The pressure release openings 40 may be formed between the plunger 32, in a starting filled position, as illustrated in FIGS. 2-3, and the first opening 34 of the tube body 30. The starting filled position of the plunger 32 may be at a predetermined maximum fill point for the sealant 14 along a length of the tube body 30. The pressure release openings 40 may be formed in the tube body 30 when it is manufactured, when it is loaded with sealant, or in the field before it is used. The pressure release openings 40 may be formed by molding, drilled in the tube body 30, formed with a hot needle, or by any other methods known in the art. The area of the pressure release openings 40 relative to the surface area of the tube body 14 may depend on a number of factors, such as a thickness of the tube body 30, a length of the tube body 30, type of sealant in the tube body 30, type of material used for the tube body 30, and the like.

As illustrated in FIGS. 2-3, the plunger 32 may fit in a slidably airtight configuration with the tube body 30 and may be pressed toward the second opening 36 of the sealant tube 12 via forced air from the sealant gun valve body 20. The plunger 32 may be made of the same flexible material as the tube body or another similarly flexible material. The plunger 32 may specifically include a sealant contact portion 42 configured to contact and press against the sealant 14 and a tube contact portion 44 configured to contact an inner surface of the tube body 30 as the plunger 32 moves through the tube body 30. Specifically, the tube contact portion 44 may extend at an angle, from the sealant contact portion 42 in a direction toward the first opening 34 of the tube body 30.

The dispensing nozzle 16 may be a hollow nozzle, such as a substantially cylindrical-shaped nozzle with two openings at opposing ends thereof and having a tapered portion at one of the opposing ends. The dispensing nozzle 16 may have screw threads 50 molded therein or other attachment features for attachment to the sealant tube 12, as later described herein. However, any dispensing nozzle may be used without departing from the scope of the invention. Furthermore, in some embodiments of the invention, the dispensing nozzle 16 may be omitted or integrally formed into the sealant tube 12 without departing from the scope of the invention.

The sealant tube 12 and/or the sealant gun 10 may further include a seal 46, such as a gasket or wiper seal, located proximate the second opening 26 of the hollow sleeve 18 and/or the second opening 36 of the tube body 30, forming an airtight seal between the hollow sleeve 18 and the tube body 30. This allows an equalization of pressure between space outward and space inward of the tube body 30. Without this seal 46, air flowing through the pressure release openings 40 would simply flow out through the second opening 26 of the hollow sleeve 18. The seal 46 may be attached to or integrally formed on the inner wall of the hollow sleeve 18 or may be attached to or integrally formed on the outer wall of the tube body 30. In some embodiments, a seal or seals may be attached to both the hollow sleeve 18 and the tube body 30.

The above described modifications to the sealant tube and sealant gun prevent the tube body 30 from inflating when subjected to pressurized air from the sealant gun 10. When pressurized air is delivered to the sealant tube 12, some of the air passes through the pressure release openings 40 formed in the tube body 30 and occupies a clearance gap 48 between the inner wall of the hollow sleeve 18 and the outer wall of the tube body 30, as illustrated in FIG. 3. This equalizes the pressure on both sides of the tube body 30 and prevents or at least limits the inflation of the tube body 30 so that the inner wall of the tube body 30 stays in contact with the edges of the plunger 32 to maintain an air-tight seal between the plunger 32 and the tube body 30. When a user no longer wishes to extrude the sealant 14 from the sealant tube 12, he or she can release the lever 28 on the sealant gun 10 to stop the flow of pressurized air from the sealant gun valve body 20 to the sealant tube 12. The pressurized air inside and outside of the tube body 30 may dissipate or may be vented from the sealant gun 10 so that equal pressure is maintained on both sides of the tube body 30.

Use of the pneumatic sealant gun 10 may include a step of loading the sealant tube 12 into the hollow sleeve 18 and activating the pneumatic sealant gun 10 to release compressed or pressurized air into the tube body 30, pressing the plunger 32 toward the sealant 14, thereby pressing the sealant 14 out of the second opening 36 of the sealant tube 12 or nozzle 16. Thus, the compressed or pressurized air flows into the tube body 30 and through the pressure release openings 40, then between the tube body 30 and the hollow sleeve 18, thereby equalizing pressure on the inner surface and the outer surface of the tube body 30. Activation of the pneumatic sealant gun 10 may be performed by opening a portion of the sealant gun valve body 20 manually or electronically and/or turning on a pressurized air source or compressed air source.

Figure 5:
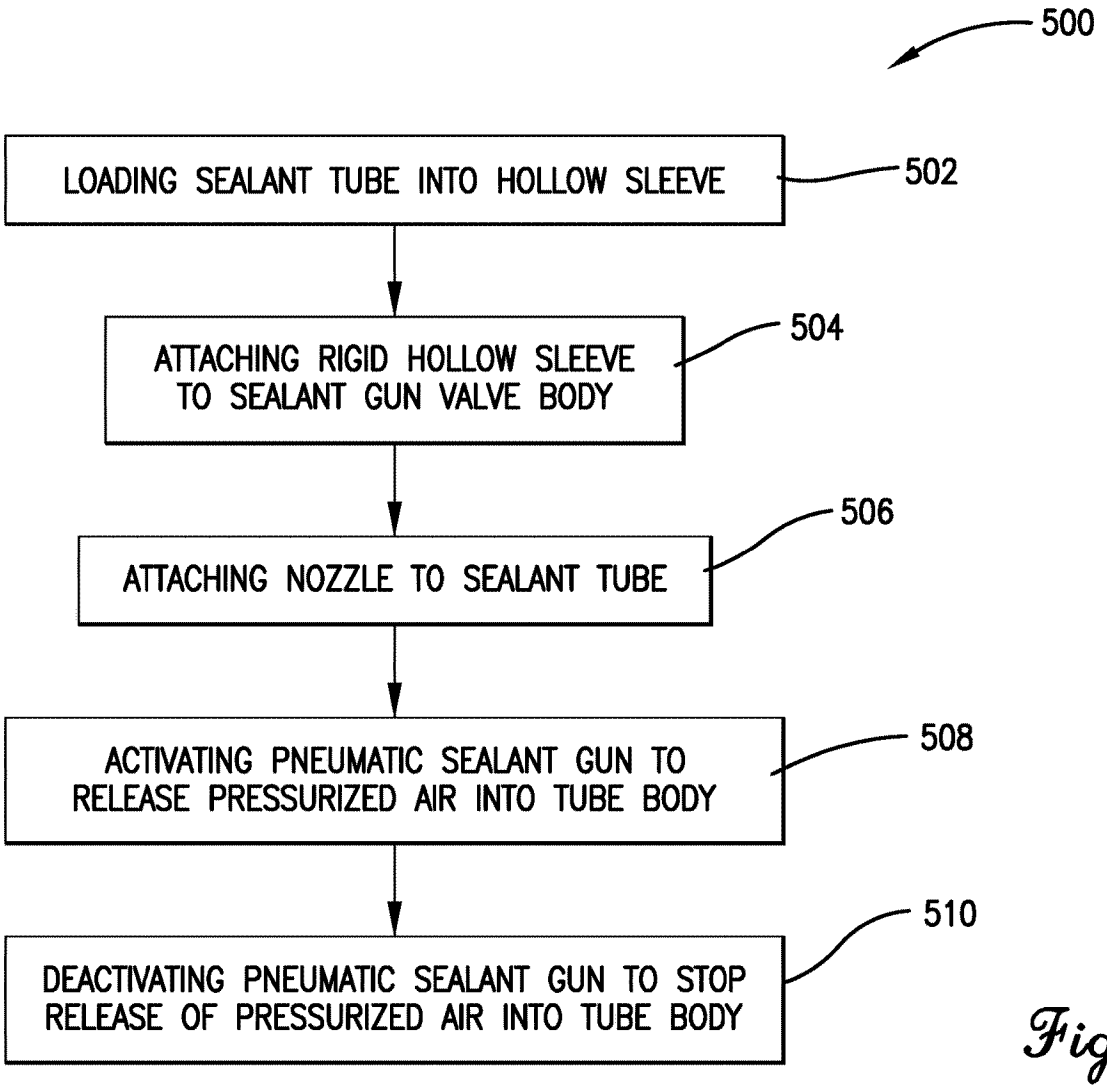
FIG. 5 is a flow chart of a method for using a pneumatic sealant gun in accordance with embodiments of the present invention.

The flow chart of FIG. 5 depicts the steps of an exemplary method 500 for using the pneumatic sealant gun 10 in more detail. In some embodiments of the invention, various steps may be omitted or steps may occur out of the order depicted in FIG. 5 without departing from the scope of the invention. For example, two blocks shown in succession in FIG. 5 may in fact be executed substantially concurrently, or blocks may sometimes be executed in the reverse order depending upon the functionality involved.

The method 500 may first include a step of loading the sealant tube 12 into the hollow sleeve 18, as depicted in block 502, and attaching the rigid hollow sleeve 18 to the sealant gun valve body 20, as depicted in block 504. Specifically, the sealant tube 12 may be slid into the hollow sleeve 18 such that the second opening 36 of the sealant tube 12 is proximate the second opening 26 of the hollow sleeve 18. In one embodiment of the invention, the mechanical attachment device 21 of the hollow sleeve 18 may be slid into the attachment slot 23 of the sealant gun valve body 20. However, other attachment devices and methods may be used without departing from the scope of the invention.

Next, the method 500 may include a step of attaching the nozzle 16 to the sealant tube 12, as depicted in block 506, via the screw threads 31,50 or any other attachment devices or methods known in the art. Then, the method 500 may include a step of activating the pneumatic sealant gun 10 to release compressed or pressurized air into the tube body 30, as depicted in block 508, thus pressing the plunger 32 toward the sealant 14, causing the plunger 32 to press the sealant 14 out of the second opening 36 or nozzle 16. During step 508, the compressed or pressurized air flows into the tube body 30 and through the pressure release openings 40, then between the tube body 30 and the hollow sleeve 18, thereby equalizing pressure on the inner surface and the outer surface of the tube body 30. Activation of the pneumatic sealant gun 10 may be performed by opening a portion of the sealant gun valve body 20 manually or electronically and/or turning on a pressurized air source or compressed air source.

Finally, the method 500 may include a step of closing the valve 27 or otherwise blocking the pressurized air from entering the tube body 30, as depicted in block 510. For example, a user may release the lever 28, and the pressurized air inside and outside of the tube body 30 may dissipate or may be vented from the sealant gun 10 so that equal pressure is maintained on both sides of the tube body 30.

Advantageously, the present invention reduces or eliminates the introduction of air into the sealant in the sealant tube 12. In prior art sealant guns, as noted above, pressurized air from the sealant gun pressurizes the sealant tube and causes it to expand or bulge outward away from its plunger such that the plunger no longer forms an air-tight seal with the inner wall of the sealant tube. This allows pressurized air from the pneumatic gun to seep between the plunger and an inner surface of the sealant tube, causing pockets of air to form in the sealant. The present invention reduces or prevents this expansion or bulging with the addition of pressure release openings 40 which allow the pressurized air to equalize on both the inner and outer surfaces of the sealant tube 12, advantageously maintaining a substantially air-tight contact between the plunger and the sealant tube inner surface.

Although the invention has been described with reference to the preferred embodiment illustrated in the attached drawing figures, it is noted that equivalents may be employed and substitutions made herein without departing from the scope of the invention as recited in the claims of a subsequent regular utility patent.

The invention claimed is:

1. A sealant tube configured for use in a pneumatic sealant gun, the sealant tube comprising:

a hollow tube body configured to fit within a hollow sleeve of the pneumatic sealant gun and to contain sealant therein, wherein the tube body has an inner surface, an outer surface opposite the inner surface, a first opening, a second opening opposite the first opening, and one or more pressure release openings formed through the tube body that permit a gas or air to flow between the tube body and a space between the tube body and the hollow sleeve during use of the pneumatic sealant gun, thereby equalizing pressure on the inner surface and the outer surface of the tube body; and a plunger within and in slidable contact with the inner surface of the tube body and configured to be pneumatically pressed toward the second opening of the tube body, wherein the one or more pressure release openings are located between the first opening of the tube body and the plunger.

2. The sealant tube of claim 1, further comprising a seal or gasket proximate the second opening of the tube body, configured for forming an airtight seal between the hollow sleeve and the tube body.

3. The sealant tube of claim 2, wherein the seal or gasket is integral to at least one of the tube body and the hollow sleeve.

4. The sealant tube of claim 1, wherein the tube body includes an engagement portion extending therefrom and configured to be sandwiched between a sealant gun valve body of the pneumatic sealant gun and the hollow sleeve of the pneumatic sealant gun.

5. The sealant tube of claim 1, wherein the tube body and the plunger is made of polyethylene.

6. The sealant tube of claim 1, wherein the tube body is cylindrical with a tapered portion at the second opening.

7. The sealant tube of claim 6, wherein the tube body has screw threads molded therein on the outer or inner surface of the tube body.

8. The sealant tube of claim 7, further comprising a nozzle having screw threads thereon configured for attachment with the screw threads of the tube body.

9. A method of using a pneumatic sealant gun, the method comprising loading a sealant tube into a hollow sleeve of the pneumatic sealant gun, wherein the sealant tube comprises:

a hollow tube body containing sealant therein, wherein the tube body has an inner surface, an outer surface opposite the inner surface, a first opening, a second opening opposite the first opening, and one or more pressure release openings formed through the tube body, a plunger within and in slidable contact with the inner surface of the tube body, wherein the one or more pressure release openings are located between the first opening of the tube body and the plunger, and a seal or gasket proximate the second opening of the tube body, forming an airtight seal between the hollow sleeve and the tube body; and activating the pneumatic sealant gun to release gas or air into the tube body, pressing the plunger toward the sealant, thereby pressing the sealant out of the second opening, wherein the gas or air flows into the tube body and through the one or more pressure release openings then between the tube body and the hollow sleeve, thereby equalizing pressure on the inner surface and the outer surface of the tube body.

10. The method of claim 9, wherein the tube body includes an engagement portion extending therefrom and configured to be sandwiched between a sealant gun valve body of the pneumatic sealant gun and the hollow sleeve of the pneumatic sealant gun.

11. The method of claim 9, wherein the tube body and the plunger is made of polyethylene.

12. The method of claim 9, wherein the seal or gasket is integral to at least one of the tube body and the hollow sleeve.

13. The method of claim 9, wherein the tube body is cylindrical with at least one of a tapered portion at the second opening and a nozzle attached to the tube body at the second opening.

14. A pneumatic sealant gun comprising:

a sealant gun valve body, configured to fluidly couple with a compressed or pressurized source of gas or air, the sealant gun valve body including a valve-controlling mechanism configured for selectively blocking or allowing the gas or air out of the sealant gun valve body;

a hollow sleeve having a first opening and a second opening opposite the first opening, wherein the hollow sleeve is fluidly coupled with the sealant gun valve body via the first opening of the hollow sleeve;

a sealant tube configured to fit within the hollow sleeve and to contain sealant therein, wherein the sealant tube comprises a hollow tube body with a first opening, a second opening opposite the first opening, and one or more pressure release openings formed through the hollow tube body, proximate the first opening, wherein the sealant tube is fluidly coupled with the sealant gun valve body at the first opening of the sealant tube such that gas or air can flow from the compressed or pressurized source into the sealant tube and between the sealant tube and the hollow sleeve, thereby equalizing pressure on an inner surface and an outer surface of the sealant tube;

a plunger within and in slidable contact with the inner surface of the sealant tube and configured to be pressed toward the second opening of the sealant tube when gas or air flows through the sealant gun valve body; and a seal or gasket proximate the second opening of the hollow sleeve, forming an airtight seal between the hollow sleeve and the inner sealant tube.

15. The pneumatic sealant gun of claim 14, wherein the sealant tube includes an engagement portion extending therefrom and configured to be sandwiched between the sealant gun valve body of the pneumatic sealant gun and the hollow sleeve of the pneumatic sealant gun.

16. The pneumatic sealant gun of claim 14, wherein the tube body and the plunger is made of polyethylene.

17. The pneumatic sealant gun of claim 14, wherein the seal or gasket is integral to at least one of the sealant tube and the hollow sleeve.

18. The pneumatic sealant gun of claim 14, wherein the sealant tube is cylindrical with a tapered portion at the second opening.

19. The pneumatic sealant gun of claim 18, wherein the sealant tube has screw threads molded therein on the outer or inner surface of the sealant tube, further comprising a nozzle having screw threads thereon configured for attachment with the screw threads of the sealant tube.

20. The pneumatic sealant gun of claim 14, wherein the one or more pressure release openings include a plurality of holes or slots having a staggered configuration.

* * * * *